OR 4,272,683

United Stat

Baatz et al.

[11] 4,272,683

[45] Jun. 9, 1981

[54] TRANSPORT AND STORAGE VESSEL FOR RADIOACTIVE MATERIALS

[75] Inventors: Henning Baatz, Essen; Dieter Rittscher, Heiligenhaus; Jürgen Fischer, Essen, all of Fed. Rep. of Germany

[73] Assignees: GNS Gesellschaft für Nuklear-Service mbH; Rheinisch-Westfälisches Elektrizitätswerk, both of Essen, Fed. Rep. of Germany

[21] Appl. No.: 940,856

[22] Filed: Sep. 8, 1978

[30] Foreign Application Priority Data

Sep. 10, 1977 [DE] Fed. Rep. of Germany ..... 2740933

[51] Int. Cl.[2] ..... G21F 5/05

[52] U.S. Cl. ..... 250/507; 250/506

[58] Field of Search ..... 252/301.1 W, 478; 250/506, 507; 428/558; 164/97, 98

[56] References Cited

U.S. PATENT DOCUMENTS

| | | | |
|---|---|---|---|
| 954,965 | 4/1910 | Jacobs | 164/97 |
| 3,016,463 | 1/1962 | Needham | 250/506 |
| 3,781,189 | 12/1973 | Kasberg | 250/506 |
| 3,828,197 | 8/1974 | Boldt | 250/506 |
| 3,853,309 | 12/1974 | Widmer | 164/98 |
| 3,962,587 | 6/1976 | Dufrane et al. | 250/507 |

FOREIGN PATENT DOCUMENTS

| | | | |
|---|---|---|---|
| 2459697 | 6/1975 | Fed. Rep. of Germany . | |
| 719896 | 12/1954 | United Kingdom | 428/558 |

*Primary Examiner*—Deborah L. Kyle
*Attorney, Agent, or Firm*—Karl F. Ross

[57] ABSTRACT

A transport and storage vessel for radioactive materials, especially irradiated nuclear-reactor fuel elements, comprises a one-piece hollow body having lateral walls and a base formed unitarily with one another and open at an upper end which is provided with a removable cover. The walls of the body have an outer layer, an intermediate layer and an inner layer, the outer and intermediate layers being cast unitarily from a carbon-containing ferrous metal or a copper alloy while the intermediate layer consists of a cast matrix phase in which heavy metal particles having a melting point above 800° C. are embedded to absorb radiation. The inner layer can be a lining of stainless steel which surrounds the chamber receiving the radioactive material.

6 Claims, 3 Drawing Figures

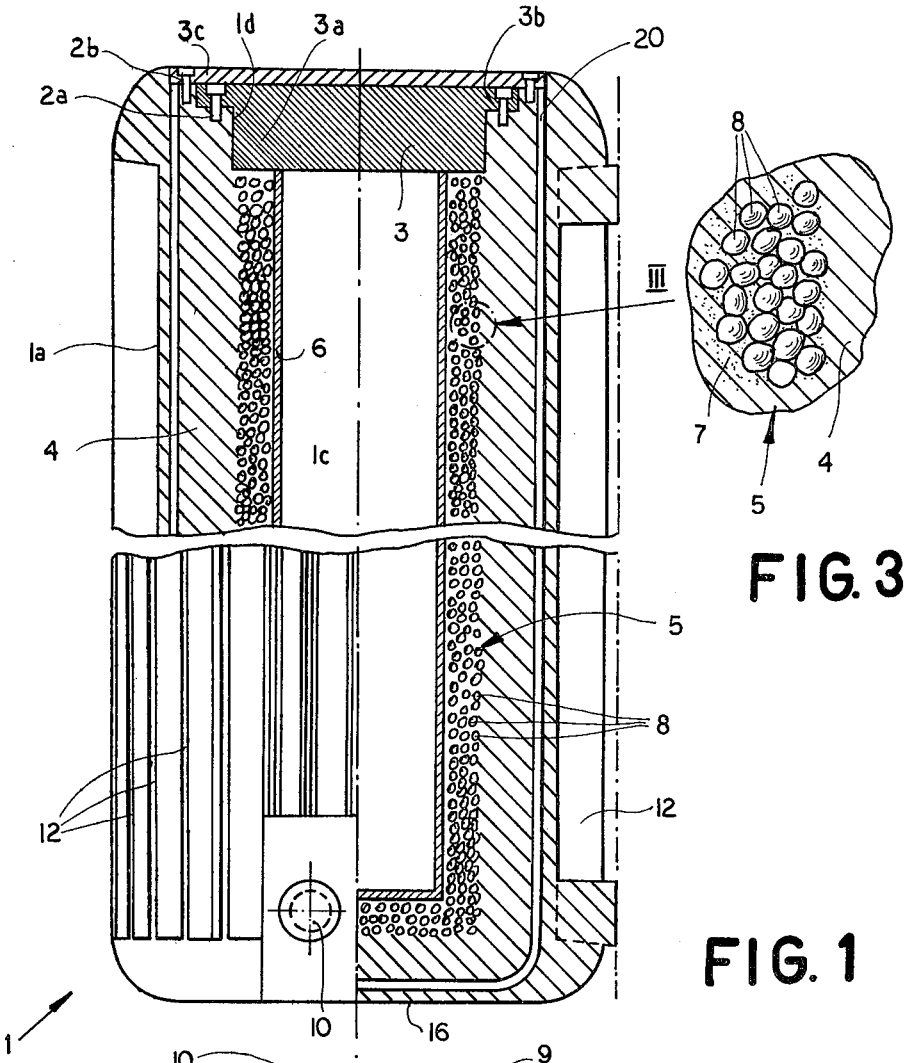
FIG. 3
FIG. 1
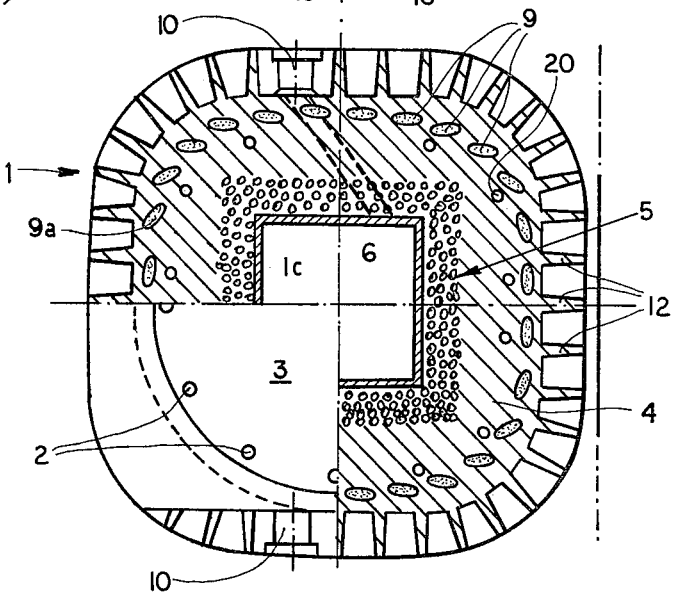
FIG. 2

TRANSPORT AND STORAGE VESSEL FOR RADIOACTIVE MATERIALS

CROSS REFERENCE TO RELATED APPLICATION

This application is related to the copending application Ser. No. 940,089 filed Sept. 1978 by Henning Baatz and Dieter Rittscher, two of the present joint inventors. Reference may also be had to the prior applications mentioned in this copending application and in the art referred to therein and in the files of the earlier applications.

FIELD OF THE INVENTION

The present invention relates to a transport and storage vessel or receptacle for radioactive materials, especially irradiated nuclear reactor fuel elements. More particularly, the invention deals with canisters or containers for such materials which are capable of withstanding mechanical stresses well above those which can be expected to arise with storage and transport without leakage and which, in addition, have sufficient radiation-shielding or radiation-absorbing capabilities to preclude any significant amount of transfer of radiation through the walls of the vessel.

BACKGROUND OF THE INVENTION

As is known in connection with the handling of radioactive materials, the storage and transport of nuclear reactor fuel elements and/or other nuclear reactor fuels and wastes, require canisters, containers, receptacles and vessels which must be sufficiently strong so as to be capable of withstanding the normal handling and storage stresses and mechanical operation, and even unusual stresses to afford a high measure of security to personnel concerned with such receptacles. Apart from the considerable mechanical stability which must be possessed by such a vessel, it must have high absorption capability so that it shields the environment and operating personnel from gamma radiation as well as radiation of other types.

One way of providing for relatively high mechanical stability and high radiation-absorbent capability is to constitute the vessel of a laminated structure having inner and outer layers and an intermediate layer between the inner and outer layers.

In one prior-art design, the inner and outer shells are formed of welded steel construction while the intermediate layer is a cast lead layer having low mechanical strength but a high absorption capability. The lead can be cast in situ between the inner and outer welded steel shells.

While containers of the aforedescribed type have been used to receive storage and transport radioactive materials, problems are encountered when such systems are employed for the storage and transport of irradiated nuclear-reactor fuel elements. Nuclear-reactor fuel elements generate considerable heat as a result of the radioactive decomposition and/or fission processes within the radioactive material.

Thus a storage vessel or receptacle for such fuel elements can consist of a pot-shaped or cup-shaped body which is open upwardly and has walls and a base defining a chamber for the radioactive material as well as a cover for the open mouth at the upper end of this chamber.

To eliminate problems resulting from the generation of heat, the walls of the hollow body of the vessel can be provided with passages permitting the flow of a coolant in a closed cycle in heat-exchanging relationship with the walls to carry away the heat developed by the radioactive material.

In the prior-art multi-layer structure, the coolant passages are formed by tubes or pipes which are welded to the steel outer layer and/or the steel inner layer.

Various testing procedures have been set up to permit the testing of vessels for the purposes described so as to insure that they will be capable of effective use for the storage and transport of radioactive materials with a minimum danger to handling personnel and, more generally, to the environment.

For example, one such test regimen requires that the vessel be dropped in free fall through a height of 9 meters on a non-yielding surface. In another regimen, the vessel is dropped through a height of 1.2 meters on a mandrel of defined configuration. Tests are carried out at temperature of about 800° C. over periods of thirty minutes.

So that the conventional fuels may withstand these tests successfully, it has been found to be necessary to make the steel outer layer especially thick to prevent complete deformation following free fall. Even with very thick welded construction of the vessel, however, it is found that the ducts or tubes welded to the steel of the vessel tend to rupture and can give rise to contamination of the environment by the release of a radioactive coolant.

Furthermore, at the temperatures at which the containers are tested and those at which the containers are used, there is a tendency for the lead intermediate layer to be melted and lose its absorption effectiveness. As a result, special insulating precautions must be taken, e.g. a moist plaster layer introduced between the steel outer layer and the lead intermediate layer.

Upon failure of the coolant cycle, moreover, there is also the danger that the lead intermediate layer may be melted by the heat generated by the radioactivity.

Finally, in connection with the conventional systems, it is found that the welded construction requires expensive non-destructive testing of the welds, especially to be sure that the welded structures can withstand the thermal stresses to which the vessel may be subjected during fabrication, testing or use. Because of the complex structure and testing problems mentioned, the conventional vessel is practically incapable of serial or mass production and is very expensive.

OBJECTS OF THE INVENTION

It is an object of the present invention to provide an improved container for the transport and storage of radioactive materials.

Another object of this invention is to provide a receptacle for the transport and storage of radioactive materials especially nuclear-reactor fuel elements which avoids the disadvantages of the earlier systems described.

Yet another object of this invention is to provide a receptacle for radioactive materials which is of high strength and low susceptibility to temperatures of up to 800° C. and which can pass successfully conventional tests for such vessels.

An object of the invention is also to provide a low-cost container for the purposes described which is amenable to serial or mass production.

SUMMARY OF THE INVENTION

These objects and others which will become apparent hereinafter are suggested in accordance with the present invention in a container, receptacle or vessel for radioactive materials, especially nuclear-reactor fuel elements which comprises an upwardly open hollow body formed by a wall and a bottom and adapted to receive a cover whereby a chamber in this body is closed. According to the invention, the body is formed from at least three layers including an outer layer, an intermediate layer and an inner layer and the outer and inner intermediate layers are cast from a high-carbon ferrous metal or copper alloy while the intermediate layer is at least in part constituted by a case matrix of this material with heavy (heaviest) metal particles embedded therein, the heavy metal particles having a melting point above 800° C. The heavy metal alloy can, of course, be a lead or heavier-metal alloy or any material having a density close to or higher than that of lead, a high-radiation-capture cross section and a melting point with the described minimum.

The particles may be randomly shaped particles such as chips, but preferably have a ball (spheroid) or globular shape with a low surface area/volume ratio. The inner layer can be a metal lining and preferably is a lining of corrosion-resistant material such as stainless steel which can be significantly thinner than the remainder of the vessel wall or bottom.

The invention is based upon our discovery that a cast outer layer has mechanical properties which are far superior to those of welded steel constructions in vessels for the purposes described because in free fall the cast body is not subjected to total deformation but rather may be flattened at locations of impact. Windows or openings in the wall of the vessel and any tubes, connecting fittings, passages cast in situ in the body or the like remain undeformed, unobstructed, and completely functional under the conventional tests mentioned previously. Consequently, from a structural point of view and from the point of view of safety with respect to the environment and handling personnel, the vessel of the present invention is far superior to the earlier systems.

Furthermore, since the cast material forming the matrix for the heavy metal particles and the cast material forming the outer portion of the wall of the vessel constitute a continuum and a one-piece structure, separation between layers is not possible and escape of radiation through cracks or the like which may result when layers are merely disposed side-by-side is avoided.

Surprisingly, the intimate surface contact of the heavy metal particles with one another and with the matrix assures rapid dissipation of heat so that external and internal temperatures well above 800° C. can develop without melting the heavy metal particles in spite of the fact that the melting point of such particles, although above 800° C., may be below the temperature to which the vessel wall is subjected. Indeed, even if some melting does occur, the entrapment of the particles in the matrix prevents migration of the dense absorptive metal.

It has been found that the system of the present invention allows a so-called "close-packed" relationship of the particles so that the intermediate layer constitutes a highly effective barrier to gamma radiation through the wall of the container.

The interior of the vessel may be subjected to a coolant circulation, e.g. with the aid of passages (tubes) as described in the aforementioned copending application Ser. No. 940,098 or other coolant passages may be embedded or formed in the cast walls. The vessel of the present invention has been found to be highly effective as a radiation barrier, to be free from danger and to have none of the disadvantages of earlier systems even upon failure of the coolant circulation.

It should be noted further that the vessel of the present invention can be lighter than the welded-steel structures of the prior art for a given radiation absorption and material capacity and can be easily manufactured by conventional casting techniques by serial or mass production. The relatively thin inner layer, which can be composed of drawn or welded stainless steel, can be provided in the mold at the time of casting and poses no problem. However, it may be advantageous to apply the inner protective layer by other techniques, e.g. galvanic coating on the cast body. Naturally, the vessel of the present invention is less expensive and simpler to manufacture than the prior-art systems.

While it is possible to conceive of fabricating the cast matrix and the outer cast body as separate layers in distinct casting operations, the best mode embodiment of the invention provides the continuum mentioned previously so that the cast matrix is unitary with the cast outer layer. The casting can be effected for this purpose in a single step although it is also possible to carry out the casting in successive steps without eliminating the continuum or integralness of the body.

The cast alloy is preferably cast iron with spheroidal graphite (globular graphite) and the heavy-metal particles can be in the best mode embodiment of depleted uranium particles, especially in the form of balls. Depleted uranium results from the preparation of uranium fuel elements in large quantities and has not been utilized economically in an effective manner heretofore.

To improve the neutron absorption capability of the body, the latter can be formed with channels or the like in which neutron absorptive material can be received. The neutron absorptive or moderator material can be, for instance, boron carbide or a material high in hydrogen. A hydrocarbon can thus be used as the moderator. It is desirable that the absorber or moderator material be distributed in the outer half of the thickness of the body wall and that this distribution be more or less uniform around the chamber receiving the radioactive material.

Additionally, coolant pipes or passages may be connected to, embedded in or otherwise placed in heat-exchanging relationship with the cast walls and base of the body.

These coolant passages allow the container, which is normally under a superatmospheric pressure to be cooled to atmospheric or lower internal pressure to permit removal of the cover without contamination of the environment.

Finally, the periphery of the vessel can be provided with cooling ribs which can be cast in situ and in one piece with the outer layer and whose external surfaces can be machined, provided with a protective coating and otherwise modified to reduce the possibility of corrosion and/or to increase heat exchange with the ambient atmosphere. The protective coating can be applied galvanically, as a metal spray and/or as a heat-fused lacquer.

BRIEF DESCRIPTION OF THE DRAWING

The above and other objects, features, and advantages of the present invention will become more readily apparent from the following description, reference being made to the accompanying drawing in which:

FIG. 1 is a vertical cross-sectional view, partly in elevation through a container according to the invention;

FIG. 2 is a transverse section through the container of FIG. 1; and

FIG. 3 is a detail view of the region III of FIG. 1.

SPECIFIC DESCRIPTION

The drawing shows a vessel for the transport or storage of radioactive materials, especially irradiated nuclear-reactor fuel elements which comprises an upwardly open cup-shaped body 1 having a lateral wall 1*a* and a base 1*b* defining a chamber 1*c* open at a mouth 1*d* upwardly. The chamber 1*c* can receive the radioactive material.

The mouth of the chamber is closed by a shielding cover 3 which comprises a plug 3*a* of cast iron containing globular graphite and surrounded by a flange 3*b* which is connected by screws 2*a* to the upper end of the body 1.

A further cover 3*c* overlies the cover 3 and is connected to the upper end of the body by screws 2*b*. The cover 3*c* may serve as a closure and coolant circulating passages 20 and/or channels 9 receiving absorber or moderator material 9*a*.

The body 1 is provided with a metallic outer layer 4 which is cast in one piece with the matrix of an intermediate layer 5 while the inner layer or lining 6 consists of stainless steel.

Thus the outer layer 4 and the cast matrix 7 of the intermediate layer 5 are cast in a single piece of high-carbon ferrous metal or from a copper alloy, preferably globular-graphite cast iron.

In the cast matrix 7 there are embedded in close-packed relationship, particles of a heavy metal with a melting point over 800° C., especially uranium-metal balls 8 which have no significant intrinsic radiation level and which can be recovered from the waste of a uranium enrichment plant.

The outer layer 4 of the cast body 4, 5 is provided with the aforementioned channels 9 which can contain a neutron absorber such as boron carbide and/or a moderator such as paraffin.

The drawing also shows that the vessel can have a pair of fittings 10 which can be closed by plugs and the like and can be threaded to allow pipes to be connected to the interior of the vessel and permit the vessel to be filled with water and discharged as required.

The outer surface of the vessel is provided with cooling ribs 12 which run along generatices of the vessel and can be cast in one piece with the outer layer. These ribs may then be machined and provided with protective coating as previously mentioned.

We claim:

1. A transport and storage vessel for radioactive materials, comprising an upwardly open body having lateral walls and a bottom defining a chamber for receiving said materials, a cover removably affixed to said body for closing said chamber, said body being cast in one piece from high-carbon ferrous metal and having an outer layer, an intermediate layer, and an inner layer, the inner and outer layers being composed of said high-carbon cast ferrous metal, said intermediate layer consisting of said high-carbon cast ferrous metal as a matrix and having heavy-metal particles of a melting point above 800° C. embedded in said matrix whereby the intermediate layer forms a gamma radiation shield, said outer layer being formed unitarily with a multiplicity of channels cast in situ and filled with a material other than said ferrous metal and resistant to penetration by neutrons whereby said outer layer forms a neutron radiation shield, said outer layer being further formed unitarily with cooling ribs over its external surfaces and cast in one piece with said outer layer from said high-carbon ferrous material.

2. The vessel defined in claim 1 wherein said cast metal is cast iron containing globular graphite.

3. The vessel defined in claim 2 wherein said particles are composed of uranium.

4. The vessel defined in claim 3 wherein said particles are balls in close-packed relationship.

5. The vessel defined in claim 4 wherein the material resistant to penetration by neutrons is boron carbide.

6. The vessel defined in claim 2, claim 3, claim 4, or claim 5, wherein said inner layer comprises a lining composed of stainless steel.

* * * * *